US005423368A

United States Patent [19]

Fitts et al.

[11] Patent Number: 5,423,368

[45] Date of Patent: Jun. 13, 1995

[54] METHOD OF FORMING SLOT-COOLED SINGLE NOZZLE COMBUSTION LINER CAP

[75] Inventors: David O. Fitts, Ballston Spa; John S. Haydon, Mayfield, both of N.Y.; Neil S. Rasmussen, Loveland, Ohio

[73] Assignee: General Electric Company, Schenectady, N.Y.

[21] Appl. No.: 222,785

[22] Filed: Apr. 4, 1994

Related U.S. Application Data

[60] Division of Ser. No. 162,971, Dec. 8, 1993, Pat. No. 5,329,772, which is a continuation of Ser. No. 987,785, Dec. 9, 1992, abandoned.

[51] Int. Cl.[6] ..... B22D 25/00

[52] U.S. Cl. ..... 164/47; 164/516

[58] Field of Search ..... 164/47, 76.1, 576

[56] References Cited

U.S. PATENT DOCUMENTS

| | | | |
|---|---|---|---|
| 1,621,002 | 3/1927 | Dimberg | 164/76.1 |
| 1,925,967 | 9/1933 | Olson | 164/76.1 |
| 2,547,619 | 4/1951 | Buckland . | |
| 2,581,999 | 1/1952 | Blatz . | |
| 2,699,648 | 1/1955 | Berkey . | |
| 2,930,193 | 3/1960 | Jaramillo . | |
| 3,360,929 | 1/1968 | Drewry . | |
| 3,854,285 | 12/1974 | Stenger et al. . | |
| 3,880,575 | 4/1975 | Cross et al. . | |
| 3,898,797 | 8/1975 | Wood . | |
| 3,901,446 | 8/1975 | Petreikis, Jr. et al. . | |
| 3,916,619 | 11/1975 | Masai et al. . | |
| 4,051,670 | 10/1977 | Pierce . | |
| 4,085,580 | 4/1978 | Slattery . | |
| 4,728,258 | 3/1988 | Blazek et al. | 164/516 X |
| 4,843,825 | 7/1989 | Clark . | |
| 4,870,818 | 10/1989 | Suliga . | |
| 4,916,905 | 4/1990 | Havercroft et al. . | |

FOREIGN PATENT DOCUMENTS

| | | | |
|---|---|---|---|
| 507225 | 12/1951 | Belgium | 164/47 |
| 823484 | 12/1951 | Germany | 164/47 |
| 3903211 | 8/1989 | Germany | 164/47 |
| 51-20410 | 6/1976 | Japan | 164/47 |
| 63-9907 | 3/1988 | Japan | 164/47 |

*Primary Examiner*—J. Reed Batten, Jr.
*Attorney, Agent, or Firm*—Nixon & Vanderhye

[57] ABSTRACT

The liner cap assembly includes an outer tubular sleeve, an inner cowl and a cone portion extending between the outer sleeve and the inner cowl. The cone portion includes a plurality of annular, concentrically arranged directional vanes on a downstream surface of the cone portion. At least the inner cowl and the cone portion are formed by casting. Plural apertures are formed in the cone portion during casting or after casting.

8 Claims, 1 Drawing Sheet

METHOD OF FORMING SLOT-COOLED SINGLE NOZZLE COMBUSTION LINER CAP

This is a divisional of application Ser. No. 08/162,971 filed on Dec. 8, 1993, and now U.S. Pat. No. 5,329,772, which is a continuation of Ser. No. 07/987,785, filed on Dec. 9, 1992, now abandoned.

BACKGROUND AND SUMMARY OF THE INVENTION

The invention relates to combustion liner cap assemblies fitted to the upstream end of combustion liners in gas turbines and, specifically, to such liner cap assemblies formed by a casting process.

Conventional single nozzle combustor liner cap assemblies use louver cooling in the cone portion of the assembly to maintain the metal temperatures of the liner cap at acceptable levels. The louvers are punched through the metal of the liner cap, leaving cracks at the ends of the slots or holes, which can grow during normal operation of the gas turbine. In time, a crack from one louver may grow and combine with other cracks with the result that portions of the liner cap may break off and pass through the turbine, causing damage to the turbine nozzles and buckets. At the same time, the cap cowl (supporting the forward tip of the nozzle) is also subject to cracking in service, and even though the cap cowl is of a thicker material, large pieces have broken away, creating an even greater potential for substantial turbine damage.

The conventional single nozzle cap assemblies as described above are not repairable without disassembling the cap from the liner. The cost of repairs to cap assemblies are usually not justified and cracked cap assemblies are usually scrapped.

In one attempt to eliminate cracking of the louvered cone portion of a single nozzle combustion liner cap, a stacked ring concept was utilized, wherein the various rings were welded or brazed together.

In another attempt to solve the problem, the cap was constructed as an integral part of the liner, but nevertheless incorporated a stacked ring construction fabricated by welding and/or brazing.

The disadvantages of these constructions was not only the welding and/or brazing requirements, but also the fact that the cap assembly was constructed of numerous pieces, and extensive fixturing was required for proper assembly and maintenance.

The principal objective of this invention, therefore, is to provide a single nozzle cap assembly which overcomes the problems experienced with prior art liner cap assemblies, by constructing the cap assembly via, for example, an investment casting process. This not only eliminates the cracking problem, but also reduces the number of parts required to make the assembly. Other objectives of the invention are to efficiently utilize cooling air for cooling the liner cap; to simplify construction of the cap assembly; to simplify repair procedures for damaged cap assemblies; and to reduce cost of manufacturing cycle time of cap assemblies.

In accordance with one exemplary embodiment of the invention, a single nozzle combustion liner cap assembly is provided in the form of an outer annular sleeve connected to an inner center ring or cowl by an angled web or cone portion formed with multiple arrays of holes for introducing air through the cone portion where it is then diverted in desired directions by cooling slots formed by integral baffles or vanes formed on the downstream side of the cone portion. In one exemplary embodiment, three baffles or directional vanes are provided on the cone portion, the two innermost of which direct air radially inwardly along the downstream surface of the cone toward the cowl, and the third of which directs air in two opposite directions, i.e., inwardly and outwardly along the cone portion. In this exemplary embodiment, the entire cap assembly is formed as one piece by an otherwise conventional investment casting process which provides accurately dimensioned cooling apertures and associated flow directional vanes or baffles without danger of cracking as in the conventional louvered sheet metal cap liner assemblies.

It will be understood that the liner cap assembly may also be of two-piece construction where, for example, the outer sleeve portion is formed separately and is welded to the one piece cone/cowl portion.

It will be further understood that the cooling apertures themselves may be provided in the cone portion after casting by, for example, drilling.

Thus, in accordance with one embodiment of the invention there is provided a liner cap assembly for a combustion liner in a turbine comprising an outer tubular sleeve portion having upstream and downstream ends; an inner annular cowl having a central opening adapted to receive a forward end of a nozzle; and an inclined annular web or cone portion extending between the outer sleeve and the inner cowl, the cone portion extending rearwardly and radially inwardly from the downstream end of the outer sleeve to the inner cowl, the cone portion provided with a plurality of cooling apertures and a plurality of directional vanes or baffles on a downstream side of the cone portion adapted to divert air passing through the cooling apertures.

Additional objectives and advantages of the subject invention will become apparent from the detailed description which follows.

DETAILED DESCRIPTION OF THE DRAWINGS

Figure 2:
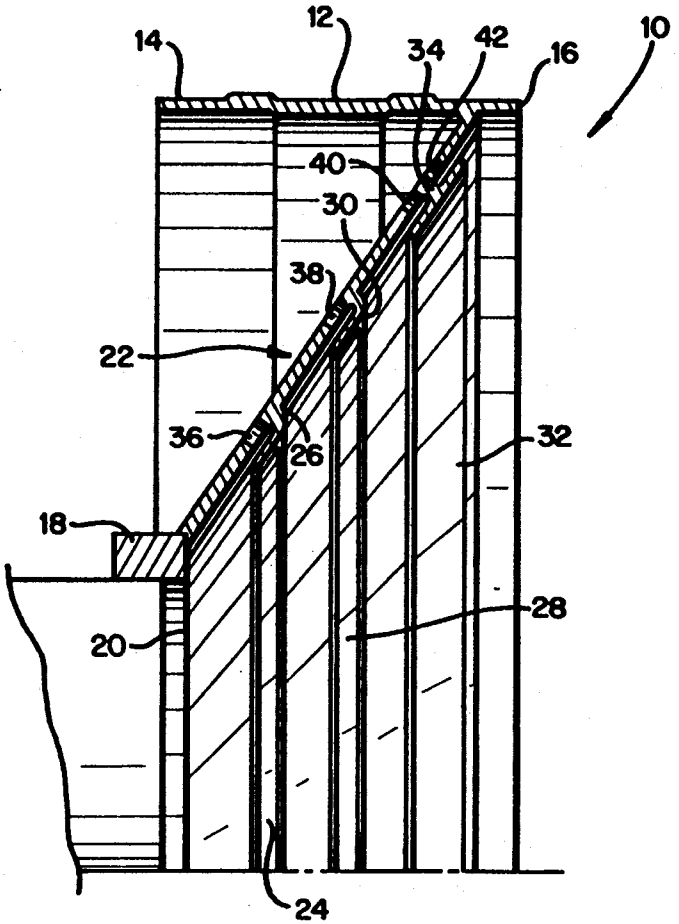
FIG. 2 is a partial cross section of the liner and cap assembly taken along section line 2—2 in FIG. 1.
Figure 1:
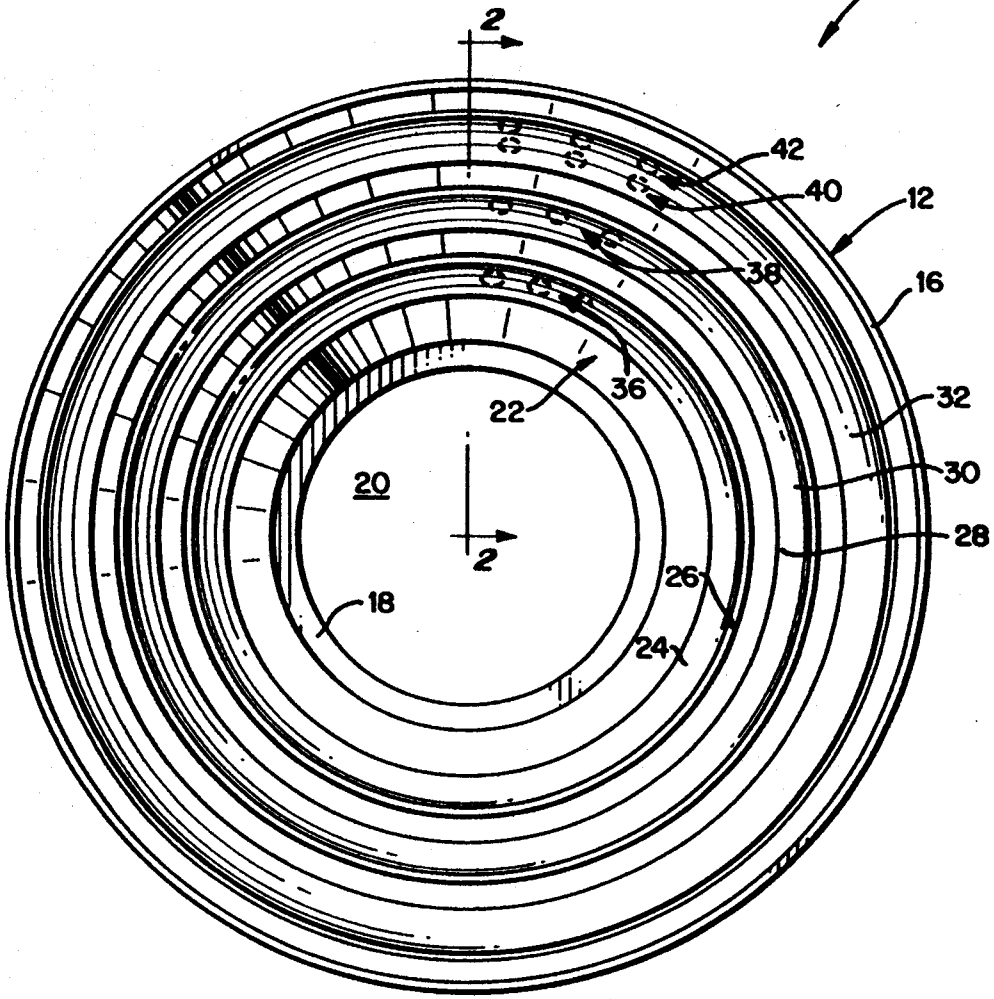
FIG. 1 is a downstream end view of a single nozzle combustion liner cap in accordance with an exemplary embodiment of the invention.

The liner cap assembly 10 includes an outer sleeve portion 12 having an upstream end 14 and a downstream end 16. The upstream end is that end closest to the forward end of the combustion liner, while the downstream end is that end which is closest to the combustion chamber within the liner. The liner cap assembly also includes a center ring or cowl 18 having a central opening 20 therein adapted to receive the forward end of a fuel nozzle (not shown) which introduces fuel into the combustion chamber defined by the liner, in a direction from left to right as viewed in FIG. 2.

The outer sleeve portion 12 and cowl 18 are connected by an inclined web or cone portion 22 which extends rearwardly from the downstream end 16 toward the upstream end 14 of the sleeve. Alternatively, the web or cone portion may extend rearwardly from the upstream end 14 of the sleeve 12. The cowl 18 is substantially concentric with the outer sleeve 12.

The cone portion 22 is provided on its downstream side with, in this exemplary embodiment, three annular directional vanes or baffles 24, 28 and 32. Vanes 24 and 28 include root portions 26, 30, respectively, while vane 32 includes a root portion 34. The root portions 26, 30 and 34 serve to space the respective vanes or baffles axially away from the downstream surface of the cone portion 22 as best shown in FIG. 2. This arrangement establishes annular cooling slots around the cone portion, the slots being formed by the spaces between the respective vanes or baffles 24, 28 and 32 and the downstream surface of the cone portion 22.

Annular arrays of cooling apertures or holes 36, 38, 40 and 42 are formed in the cone portion 22 radially inwardly of root portions 26 and 30, and on either side of root portion 34 (only a few are shown in the Figures), so that air passing through the apertures (also from left to right as viewed in FIG. 2) will be deflected by the vanes or baffles 24, 28 and 32 on the downstream side of the cone portion 22. More specifically, vanes 24 and 28 will direct the cooling air radially inwardly along the downstream surface of the cone portion 22 toward the cowl 18, while vane 32, by reason of the arrangement of cooling apertures on either side of the root portion 34, will direct air radially inwardly and radially outwardly along the downstream surface of the cone portion 22 toward both the cowl 18 and outer sleeve 12, respectively.

The arrangement of directional vanes or baffles as described above may be altered in accordance with particular applications. It will further be appreciated that the exact number and shape of the cooling apertures and the location of such apertures may be determined through thermal analysis and testing which form no part of this invention. In addition, the number of holes will, of course, also be determined by the amount of air required for combustion within the combustion liner. In one example, for a liner cap having an outer diameter of from about 10 to 14 inches, apertures 36, 38, 40 and 42 may each have a diameter of about 0.090" and a circumferential spacing of about 4× the diameter of the holes. These dimensions are merely exemplary and otherwise form no part of the invention. Depending upon the particular application, the cooling apertures may also be oriented to direct the cooling air with a rotational component if so desired.

It will further be appreciated that the cap liner assembly as described above will be cast in one piece in a preferred embodiment, in accordance with conventional investment casting procedures. It will be understood, however, that the sleeve portion 12 may be constructed separately and welded to the cone portion 22. This may be advantageous particularly where, in accordance, with an alternative construction, the cooling apertures 36, 38, 40 and 42 are drilled in the precast cone portion 22. It will be appreciated that drilling the apertures also eliminates the cracking problem experienced with conventionally formed louvers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a method of forming a liner cap assembly for a turbine combustor liner, wherein the liner cap assembly includes an outer tubular sleeve, an inner cowl, and a cone portion extending between said outer sleeve and said inner cowl, the improvement comprising the steps of a) casting at least said inner cowl and said cone portion, said cone portion cast to include a plurality of annular, concentrically arranged directional vanes on a downstream surface of said cone portion, and b) forming a plurality of apertures in said cone portion.

2. The method of claim 1 wherein the outer tubular sleeve is cast in integral, unitary fashion in surrounding relationship to the cone portion.

3. The method of claim 1 wherein said outer tubular sleeve is welded to said cone portion in surrounding relationship therewith.

4. The method of claim 1 wherein said plurality of apertures are formed in said cone portion during casting of said cone portion.

5. The method of claim 1 wherein said plurality of apertures are formed after casting of said cone portion.

6. The method of claim 1 wherein, in step a), each directional vane is cast to include a ring having a first portion extending from said downstream surface of said cone portion and a second portion extending parallel to said downstream surface of said cone portion.

7. The method of claim 6 wherein step b) includes forming the plurality of apertures in at least one annular array adjacent the first portion of each directional vane and on a side of said first portion which is proximate said second portion.

8. The method of claim 6 wherein, in step a), said second portion of at least one of said directional vanes is cast to extend in opposite directions from said first portion and, in step b), an annular array of said apertures is formed on either side of said first portion of said at least one of said directional vanes.

* * * * *